US005388629A

United States Patent [19]

Kami

[11] Patent Number: 5,388,629

[45] Date of Patent: Feb. 14, 1995

[54] DEVICE AND METHOD FOR DETECTING ABNORMALITY IN DIE CASTING DURING EJECTION THEREOF

[75] Inventor: Shigetake Kami, Tokyo, Japan

[73] Assignee: Ryobi Ltd., Hiroshima, Japan

[21] Appl. No.: 174,267

[22] Filed: Dec. 28, 1993

[30] Foreign Application Priority Data

Dec. 28, 1992 [JP] Japan ..... 4-360592

[51] Int. Cl.[6] ..... B22D 29/04; B22D 17/00

[52] U.S. Cl. ..... 164/4.1; 164/113; 164/131; 164/151.1; 164/154.1; 164/347; 164/312

[58] Field of Search ..... 164/4.1, 131, 113, 150.1, 164/151.1, 154.3, 154.1, 347, 312

[56] References Cited

FOREIGN PATENT DOCUMENTS 5-104229 4/1993 Japan ..... 164/131

*Primary Examiner*—Kuang Y. Lin

*Attorney, Agent, or Firm*—Sughrue, Mion, Zinn, Macpeak & Seas

[57] ABSTRACT

A device for detecting galling which may produce deformations during an ejection process of die castings from a die. The device includes a setting device for storing a predetermined set value, the predetermined set value including an upper limit of acceleration of an ejector plate during the ejection process and a predetermined time period during the ejection process. An accelerometer is disposed to the ejector plate for measuring the acceleration thereof during the ejection process. A computing device is provided for comparing the acceleration measured by the accelerometer with the predetermined set value and outputting a warning signal when the acceleration measured at the accelerometer exceeds the upper limit during the time period. Thus, timely detection of galling can result.

7 Claims, 4 Drawing Sheets

DEVICE AND METHOD FOR DETECTING ABNORMALITY IN DIE CASTING DURING EJECTION THEREOF

BACKGROUND OF THE INVENTION

The present invention relates to a device and method of detecting abnormality in ejecting die castings from a die, and more particularly, to such device and method of predicting deformation of the die castings, which may be deformed during the ejection thereof from the die.

A plurality of reversibly slidingly movable ejector pins are conventionally provided for separating and ejecting die castings from a die. The ejector pins are reversibly slidably disposed in pin guide though holes formed in the die. One end of each ejector pin of each ejector pin is fixed to an ejector plate. The ejector plate is connected to a well-known hydraulics cylinder, and is returnably slidable therewith. Consequently, when the hydraulics cylinder slides the ejector plate in an ejection direction, the end of each ejector pin not connected to the ejector plate slides into the die cavity and ejects the die castings from the die.

One cause of deformation in die castingss is galling generated during ejection of the die castings. Such galling prevents uniform ejection of the product from the die. Galling during ejection is produced from various sources such as temperature of the molten metal, temperature distribution of the die, surface condition of the die, and coating condition of release agent. Galling tends to repeat once induced, so that deformed products are consecutively produced rather than in isolated cases.

Conventionally, deformations in die castingss are controlled by measuring size of the die castings produced at a predetermined interval to determine whether or not they meet a set of dimensional standards. Further, the degree of galling generated during ejection is conventionally detected by measuring the hydraulics in the hydraulic cylinder which drives the ejector plate.

However, there has been known a problem with controlling deformations by measuring dimensions of die castingss in that when a defective product is discovered, all the products produced since the previous measurement must also be measured, wasting a great deal of time and expense. Because defective die castingss are measured only at a predetermined interval and not discovered during casting, many defective products may be cast before one in a series of defective products is discovered.

Measuring hydraulics in the hydraulics cylinder can reveal the maximum resistance against the ejector plate, but not details of abnormal movements in the ejector plate. Therefore, differentiating between galling produced at different places is impossible and galling related to generation of distortions can not be detected.

SUMMARY OF THE INVENTION

It is therefore, an object of the present invention to provide a device and method for detecting an abnormality in die castings during ejection thereof from a die.

Another object of the present invention is to provide such device and method capable of detecting abnormal movement of an ejector plate so as to avoid production of large numbers of die castingss each having dimensional error.

These and other objects of the present invention will be attained by providing a device for detecting an abnormality in ejection of die castings from a die, the die castings being ejected by a movement of an ejector mechanism in a moving direction, the device including setting means, an accelerometer, and comparing means. The setting means is provided for setting a predetermined set value. The predetermined set value includes an upper limit of acceleration of the movable ejector mechanism during the ejection and a predetermined time period during which change in acceleration of the movable ejector mechanism occurs. The accelerometer is disposed to the movable ejector mechanism for measuring the acceleration thereof during the ejection. The comparing means is provided for comparing the acceleration measured by the accelerometer and during the predetermined time period with the predetermined set value and for outputting a warning signal when the acceleration measured at the accelerometer exceeds the upper limit.

In another aspect, in the present invention, there is provided a method for detecting an abnormality in ejection of die castings from a die, the die castings being ejected by a movement of an ejector mechanism in a moving direction, the method comprising the steps of (a) provisionally setting a predetermined set value, the predetermined set value including an upper limit of acceleration of the movable ejector mechanism during the ejection and a predetermined time period during which change in acceleration of the movable ejector mechanism occurs, (b) measuring the acceleration of the ejector mechanism by an accelerometer disposed thereto during the ejection, (c) comparing the acceleration measured by said accelerometer with the predetermined set value, and (d) outputting a warning signal when the acceleration measured at the accelerometer exceeds the upper limit during the predetermined time period.

The movement of an ejector mechanism such as an ejector plate is monitored during an ejection process of die castings using an accelerometer attached to the ejector mechanism. When acceleration equal to or greater than a preset upper limit value is detected during a preset time period, an output, such as a warning signal is produced to warn an operator of an ejection abnormality. Starting or stopping the ejector mechanism usually generates a rising edge in the acceleration waveform of the ejector mechanism.

However, a rising edge in the acceleration waveform is also generated when the ejector mechanism is suddenly freed to move after being urged in the direction of the mold cavity but obstructed from moving. This is due to the fact that the hydraulics in the ejection cylinder becomes very high while the movement of the ejector mechanism is obstructed. Movement of the die castings from the die is obstructed, for example, when a portion of die castings becomes firmly stuck to the die. Alternatively, the die castings becomes lightly stuck to the die. Under such circumstances, entire outer surface of the die castings does not uniformly separate from the mold cavity, but the die castings may separate therefrom with a tilted orientation. When pushed further, the die castings can move at a tilt. Further movement may be obstructed if one portion of the tilted die castings abuts another portion of the mold cavity to cause galling. Therefore, a quick change in acceleration can be generated at one place or at a plurality of places simultaneously or at different times.

According to the present invention, galling generated at different times can be recognized independently, and the galling situation can be more precisely controlled.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
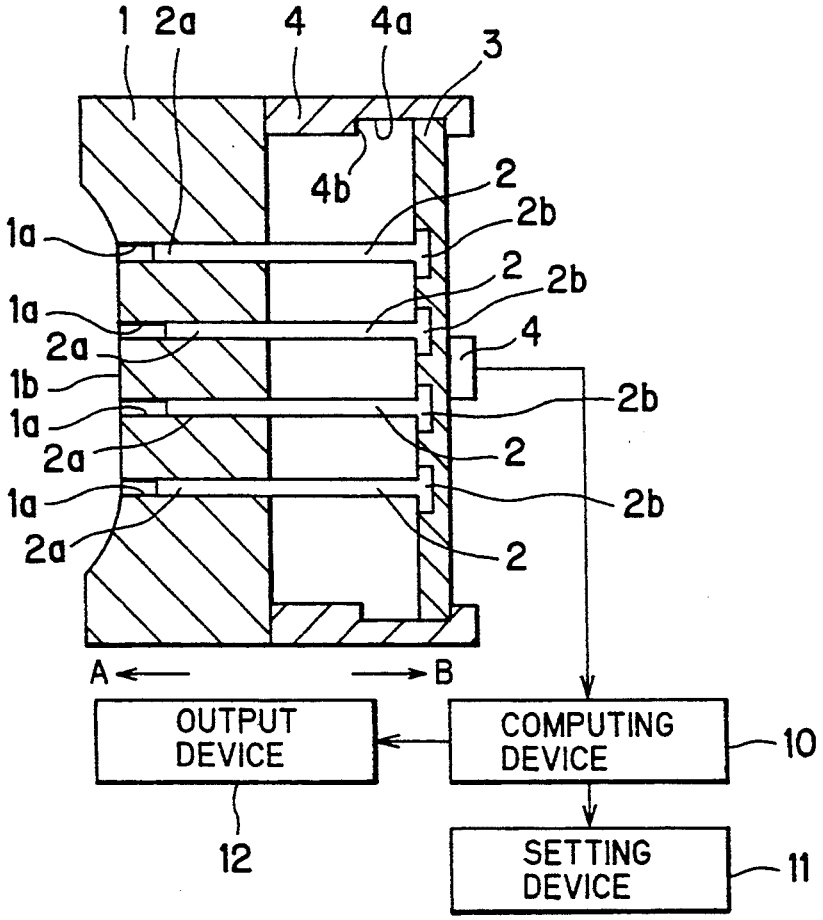
FIG. 1 is a schematic cross-sectional view showing a method according to a first preferred embodiment of the present invention for detecting an abnormality during ejection of die castings.

A device for detecting an abnormality in ejection of die castings from a die according to a first preferred embodiment of the present invention will be described while referring to FIG. 1.

A plurality of ejection pin guide holes 1*a* are formed through a movable die 1. A plurality of ejector pins 2 are disposed in the ejector pin guide holes 1*a* so as to be slidable in the directions indicated by arrows A and B. One end 2*b* of each ejector pin 2 is fixed to an ejector plate 3. The other end 2*a* of each ejector pin 2 can be slid into a mold cavity 1*b*. The ejector plate 3 is slidably provided in a guide groove 4*a* formed in an ejector plate guide 4. The ejector plate 3 is connected to a well-known hydraulic cylinder (not shown). When the ejector plate 3 moves in the direction indicated by arrow A, the end 2*a* of each ejector pin 2 moves into the cavity 1*b* until the ejector plate 3 abuts a stop portion 4*b* of the ejector plate guide groove 4*a*. The ends 1*a* of the ejector pins 2 push against die castings (not shown) in the mold cavity 1*b*, separating and ejecting the die castings from the cavity.

To the side of the ejector plate 3 opposite the side with the ejector pins 2 connected thereto is fixed an accelerometer 4 for detecting acceleration of the ejector plate 3. The accelerometer 4 is constructed so that it is most sensitive to acceleration when moved in a certain direction. This direction can be termed its axis of sensitivity. The accelerometer 4 is fixed with its axis of sensitivity aligned with the direction in which the ejector plate 3 returnably slides. The accelerometer 4 is connected to a computing device 10. Acceleration data detected by the accelerometer 4 is inputted to the computing device 10. The computing device 10 is connected to a setting device 11 and an output device 12.

Prior to performing ejection processes, a set value is determined by tests and inputted to the setting device 11. In these tests, waveform at the time of occurrence of deformation of the die castings is analyzed, and is measured a time at which the abnormal movement of the ejector plate 3 occurs, the time being counting from an ejection signal, and the abnormal movement being the cause of the deformation. Also measured is the change in acceleration of the ejector plate 3 in these tests. Thus, the set value is constituted by the time period relative to the output of the ejection signal and an upper limit of the acceleration.

The computing device 10 is adapted for comparing the set value with the acceleration data inputted from the accelerometer 4 and for outputting a warning signal to the output device 12 when the computing device 10 determines that the acceleration data exceeds the set value. The output device 12 is adapted for generating a warning upon receipt of the warning signal.

In summary, in response to the ejection signal, the accelerometer 4 measures the acceleration of the ejector plate 3 during the ejection process. When the measured acceleration is equal to or greater than the upper limit during the set time period previously inputted to the setting device 11, the output device 11 outputs a warning.

EXAMPLE 1

Figure 2:
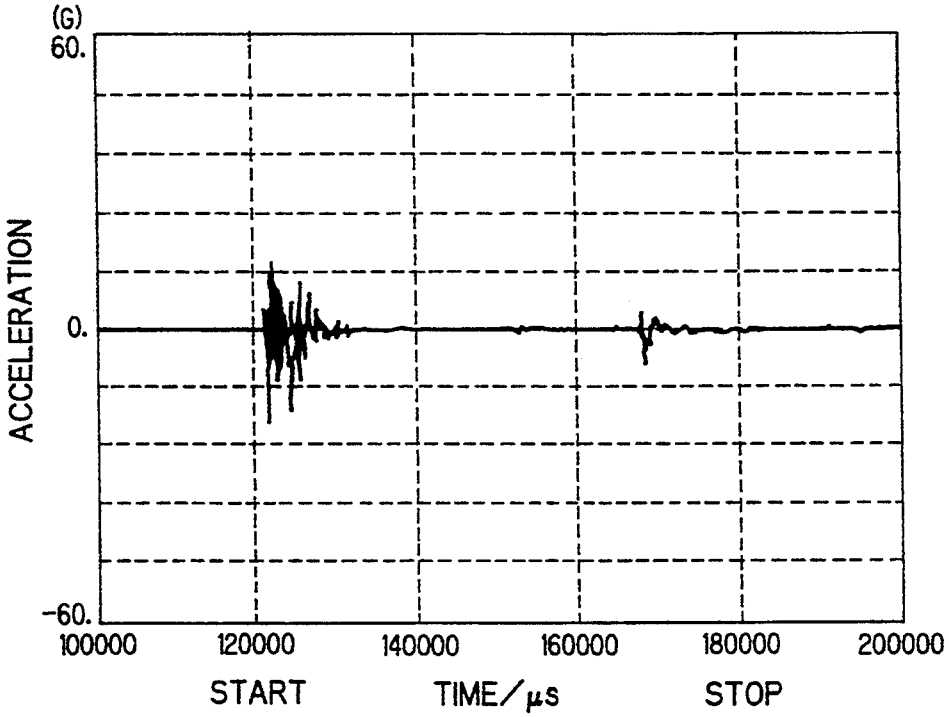
FIG. 2 is a graph showing a first concrete example of changes in acceleration of an ejector plate during normal movement of the ejector plate.
Figure 3:
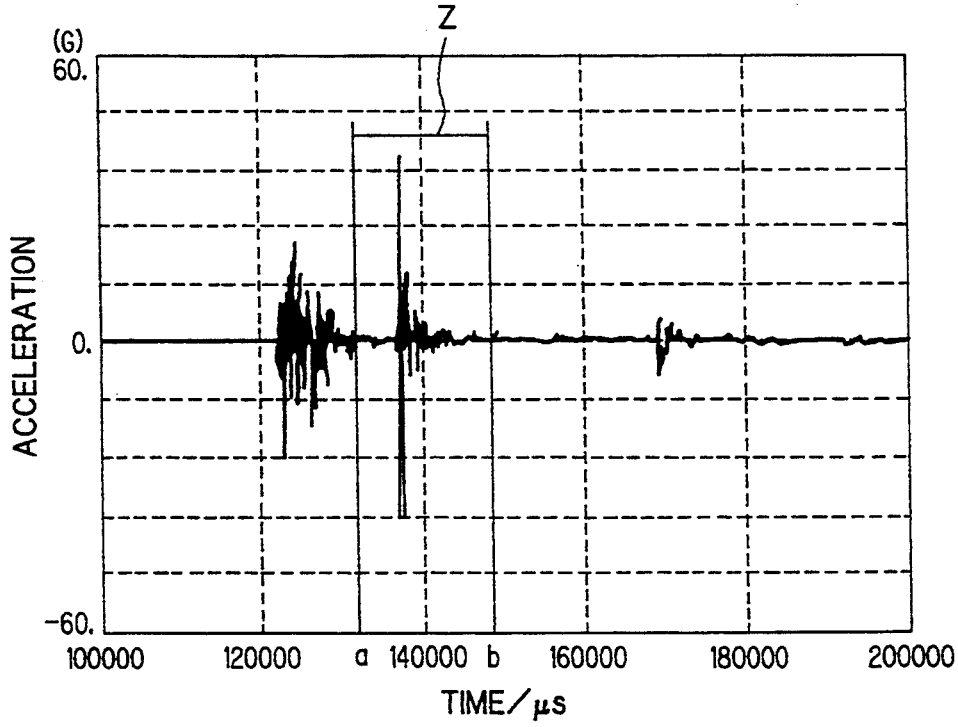
FIG. 3 is a graph showing a first concrete example of changes in acceleration of an ejector plate when an abnormal movement of the ejector plate is recognized.

Waveforms representing acceleration of an ejector plate 3 and generated during ejection of a rocker arm casted by a 90 ton die-casting machine were recorded with a sampling interval of 50 μsec. as shown in FIGS. 2 and 3. As can be seen in FIG. 2, acceleration only changed at only two time periods during normal ejection processes: soon after the ejector plate 3 started moving and just before the ejector plate 3 stopped moving. This is because after the ejector plate starts moving, hydraulics increases in the ejection cylinder (not shown) to drive the ejector plate 3. Thus, acceleration changes because of the surge generated when the ejector plate 3 starts moving. Once the ejector plate 3 starts moving, its acceleration remains stable (at near zero acceleration) until it impacts the stop portion 4*b* of the guide groove 4*a*, whereupon another change in acceleration is produced.

As shown in FIG. 3, an abnormal movement of the ejector plate 3 caused acceleration to change at a time period Z set in the setting device, the time period being other than immediately after the ejector plate 3 started moving and immediately before the ejector plate 3 stopped moving, i.e., between time a and time b. The abnormal movement produced a rising edge in acceleration recognizable during the set time period Z. This rising edge is distinct from those generated directly after the ejector plate 3 starts moving and directly before it stops. Products producing the waveform shown in FIG. 3 when ejected all showed galling, and the dimension of the center boss of the rocker arm was outside standard values in each case.

EXAMPLE 2

The second concrete example compares measuring the acceleration of the ejector plate 3 with measuring the hydraulics in the cylinder to detect an abnormality in ejection. The accelerometer 4 was mounted on the ejector plate 3 with its axis of sensitivity aligned in the direction of the movement of the ejector plate 3. Measurements were taken at a sampling interval of 100 μsec during casting of a ring-shaped sample in a 90 ton die-casting machine.

Figure 4:
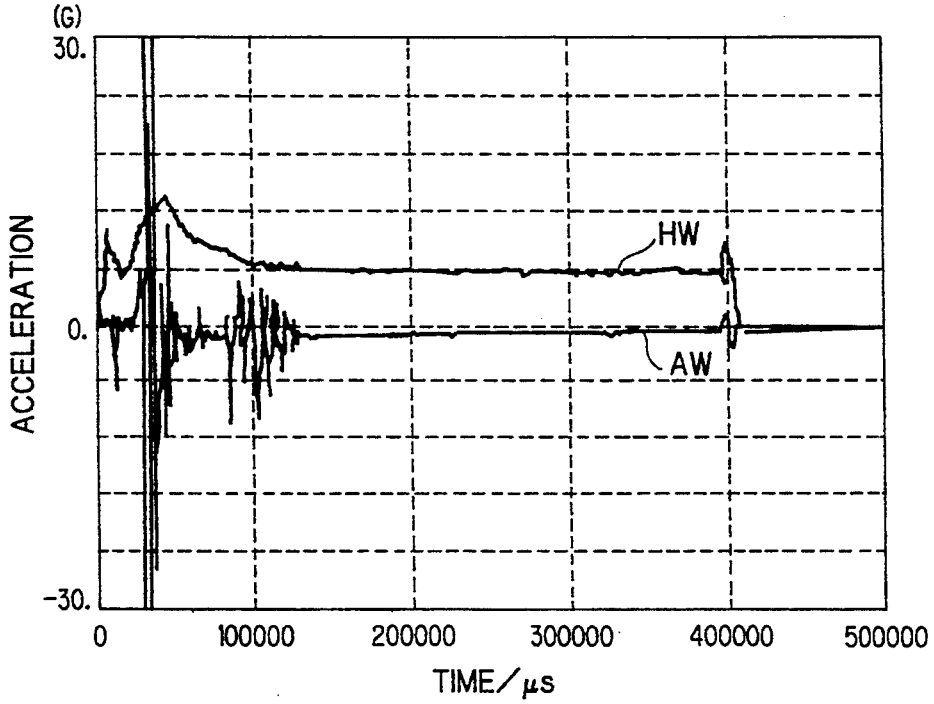
FIG. 4 is a graph showing a second concrete example of changes in acceleration (A) in of an ejector plate and changes in hydraulics (P) in an ejection cylinder when an abnormal movement of the ejector plate is recognized.
Figure 5:
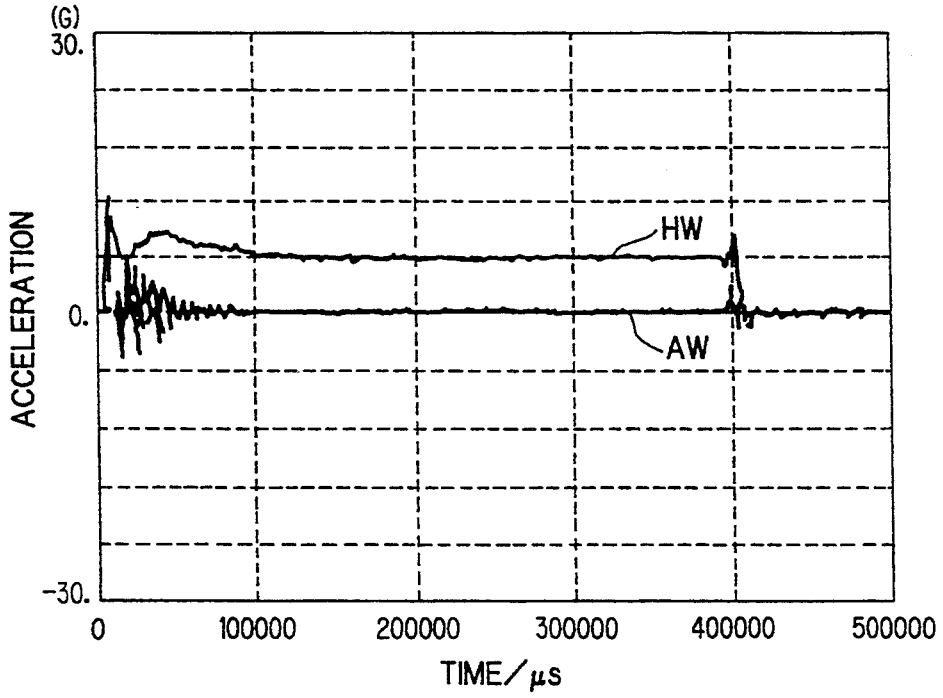
FIG. 5 is a graph showing a second concrete example of changes in acceleration (A) of an ejector plate and changes in hydraulics (P) in an ejection cylinder during a normal ejection movement of the ejector plate.

FIG. 4 shows normal waveforms measured during an abnormal casting operation. FIG. 5 shows normal waveforms measured when galling occurred. In both graphs, the acceleration waveform (AW) represents the acceleration of the ejector plate 3 and the hydraulics waveform (HW) represents change in the hydraulics in the ejector cylinder (not shown). By comparing the acceleration waveforms in FIGS. 4 and 5, it can be clearly seen that galling caused a comparatively large change in acceleration at the start of ejection. Galling also caused hydraulics to increase at the start of ejection, but differences between the abnormal and normal acceleration waveforms is much more striking than between the abnormal and normal hydraulics waveforms. The acceleration waveform shown in FIG. 5 further indicates that a change in acceleration occurred other than when the ejector plate 3 started and stopped moving. The hydraulics waveform in FIG. 5 does not show the rising edge indicating pressure change as clearly as the acceleration waveform shows the rising edge indicating a change in acceleration. Consequently, it becomes apparent that measurements of acceleration show movement of the ejector plate 3 in much more detail than measurements of the hydraulics in the ejection cylinder.

EXAMPLE 3

Figure 6:
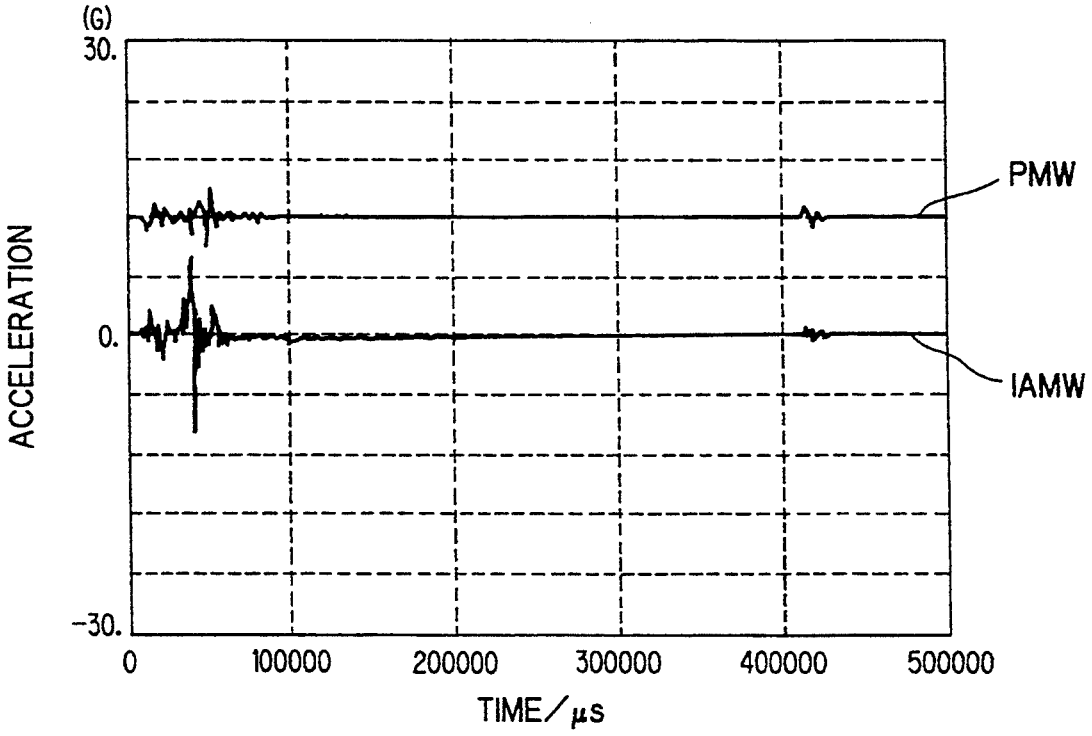
FIG. 6 is a graph showing a third concrete example of changes in acceleration of an ejector plate when (a) the axis of sensitivity of the accelerometer is aligned in the moving direction of the ejector plate and when (a) the axis of sensitivity of the accelerometer is perpendicular to the moving direction the ejector plate.

In a third concrete example, the acceleration of the ejector plate 3 was measured during casting of a ring-shaped sample in a 90 ton die-casting machine at a 100 μsec sampling interval using two accelerometers. One of the accelerometers was mounted with its axis of sensitivity aligned parallel with the movement of the ejector plate, thereby measuring the in-alignment-measured waveform (IAMW) shown in FIG. 6. The other accelerometer was mounted with its axis of sensitivity aligned perpendicular to the direction of movement (i.e., in the direction perpendicular to the cross-sectional cut shown in FIG. 1), thereby measuring the perpendicularly-measured waveform (PMW) shown in FIG. 6.

Although the perpendicularly aligned accelerometer produced a smaller output than the parallel aligned accelerometer, as can be seen by comparing perpendicularly-measured waveform (PMW) with the in-alignment-measured waveform (MIAW), both have the similar profile. This shows that the acceleration of the ejector plate can be observed by mounting the accelerometer with its axis of sensitivity perpendicularly to the movement of the ejector plate. Incidentally the perpendicularly-measured waveform (PMW) was plotted on the graph in FIG. 6 four units of gravitational acceleration (4 G) above the in-alignment-measured waveform (IAMW) to prevent overlapping of the waveforms.

According to a method of the present invention for detecting abnormalities in an ejection operation of die castings, by monitoring the movement of the ejector plate using an accelerometer, the details of changes in acceleration of the ejector plate during the ejection process can be known. Because galling which occurs during an ejection process appears as changes in the acceleration, galling occurred during the ejection process and other than at the start or stop of ejection can be detected independently of each other. Therefore, galling condition can be more precisely detected, and defective products can be promptly recognized by monitoring changes in acceleration during ejection of the product. Accordingly, galling can be managed with greater precision. By quickly advising an operator that an ejection abnormality accompanying galling has occurred, anti-galling measures can be quickly implemented to prevent further production of dimensionally defective products.

While the invention has been described in detail with reference to specific embodiments thereof, it would be apparent to those skilled in the art that various changes and modifications may be made therein without departing from the spirit of the invention.

What is claimed is:

1. A device for detecting an abnormality in ejection of die castings from a die, the die castings being ejected by a movement of an ejector mechanism in a moving direction, the device comprising:

setting means for setting a predetermined set value, the predetermined set value including an upper limit of acceleration of the movable ejector mechanism during the ejection and a predetermined time period during which change in acceleration of the movable ejector mechanism in a die casting machine occurs;

an accelerometer disposed to the movable ejector mechanism for measuring the acceleration thereof during the ejection; and comparing means for comparing the acceleration measured by said accelerometer and during the predetermined time period with the predetermined set value and for outputting a warning signal when the acceleration measured at the accelerometer exceeds the upper limit.

2. A device as claimed in claimed 1, wherein the accelerator includes an axis of sensitivity directing in a direction parallel to the moving direction.

3. A device as claimed in claimed 1, wherein the accelerator includes an axis of sensitivity directing in a perpendicular to the moving direction.

4. A device as claimed in claimed 1, further comprising warning means connected to the comparing means for receiving the warning signal and producing a warning upon receipt of the warning signal.

5. A device as claimed in claimed 2, further comprising warning means connected to the comparing means for receiving the warning signal and producing a warning upon receipt of the warning signal.

6. A device as claimed in claimed 3, further comprising warning means connected to the comparing means for receiving the warning signal and producing a warning upon receipt of the warning signal.

7. A method for detecting an abnormality in ejection of die castings from a die, the die castings being ejected by a movement of an ejector mechanism in a moving direction, the method comprising the steps of:

provisionally setting a predetermined set value, the predetermined set value including an upper limit of acceleration of the movable ejector mechanism during the ejection and a predetermined time period during which change in acceleration of the movable ejector mechanism occurs;

measuring the acceleration of the ejector mechanism by an accelerometer disposed thereto during the ejection;

comparing the acceleration measured by said accelerometer with the predetermined set value; and outputting a warning signal when the acceleration measured at the accelerometer exceeds the upper limit during the predetermined time period.

* * * * *